US006178755B1

(12) United States Patent
Castellanet

(10) Patent No.: US 6,178,755 B1
(45) Date of Patent: Jan. 30, 2001

(54) PLANT AND PROCESS FOR SUPPLYING HELIUM TO A PLURALITY OF PRODUCTION LINES

(75) Inventor: Frederic Castellanet, Le Pecq (FR)

(73) Assignee: L'Air Liquide, Paris Cedex (FR)

( * ) Notice: Under 35 U.S.C. 154(b), the term of this patent shall be extended for 0 days.

(21) Appl. No.: 09/359,355

(22) Filed: Jul. 21, 1999

(30) Foreign Application Priority Data

Jul. 29, 1998 (FR) ..... 98 09694

(51) Int. Cl.[7] ..... F17C 9/02
(52) U.S. Cl. ..... 62/50.1; 62/50.2; 62/639
(58) Field of Search ..... 62/50.1, 50.2

(56) References Cited

U.S. PATENT DOCUMENTS 4,559,786 12/1985 Schuck ..... 62/50.2
4,961,325 * 10/1990 Halvorson et al. ..... 62/50.1
5,243,821 * 9/1993 Schuck et al. ..... 62/50.1
5,386,707 2/1995 Schulte et al. ..... 62/50.2
5,934,081 * 8/1999 Notaro et al. ..... 62/50.2

FOREIGN PATENT DOCUMENTS 0 669 287 8/1995 (EP) .
0 802 160 10/1997 (EP) .

* cited by examiner

*Primary Examiner*—Ronald Capossela
(74) *Attorney, Agent, or Firm*—Young & Thompson

(57) ABSTRACT

Plant for supplying helium to a plurality of production lines, comprising a helium source of at least 7000 liters; a network of secondary ducts, feeding production lines using helium gas; and a main duct for conveying helium, connected upstream to the helium source and downstream to the network of secondary ducts. Such a plant is useful in a filling operation for diving gas cylinders, dirigible airship gas bags or safety airbag inflation containers, for quenching metal articles, or for fabricating electronic products or optical fibers.

19 Claims, 3 Drawing Sheets

PLANT AND PROCESS FOR SUPPLYING HELIUM TO A PLURALITY OF PRODUCTION LINES

FIELD OF THE INVENTION

The present invention relates to a plant and to a process for supplying helium, preferably in liquid or supercritical form, to a plurality of production lines on an industrial site.

BACKGROUND OF THE INVENTION

Currently, helium in gas form is used in a large number of different industrial sectors, in particular in the electronics industry, for cooling silicon wafers, or inerting printed circuits, for example, or in the glass industry, for example for cooling optical fibres during their fabrication process.

Conventionally, the helium is first delivered in liquid form in a large quantity to a transfer and re-storage station, in which the helium is vaporized then compressed before being forwarded to the site where it is used by being stored either in gas cylinders or similar containers whose size may vary but whose capacity is never more than a few hundreds of litres. This is, moreover, summarized in document U.S. Pat. No. 5,386,707 (Col. 1, 1. 30–35).

Furthermore, in certain cases, the liquid helium is directly conveyed to the site where it is used in a low-capacity storage reservoir, generally in a reservoir having a volume of less than 3000 litres, where it can be stocked before being conveyed in gas form to a utilization site.

In this case, when the utilization site contains a plurality of production lines, each using large amounts of helium gas, the amounts used varying from one line to another, it is essential to provide as many helium-gas reservoirs as there are production lines, that is to say each production line needs to be connected, by means of an individual duct, to a helium reservoir which is specific to it, for example helium cylinders, so that each of the production lines can be fed independently of the others as a function of the helium requirements of the line in question.

Such devices are in particular described in documents U.S. Pat. No. 5,386,707, U.S. Pat. No. 4,607,490, U.S. Pat. No. 4,766,731, U.S. Pat. No. 3,415,069, U.S. Pat. No. 4,972,677, U.S. Pat. No. 4,444,572 and JP-A-6241654.

However, these known plant types have several drawbacks, namely:

- the fact that it is necessary to re-store the liquid helium in helium gas form in a transfer station causes a considerable increase in the costs of transporting and storing the fluid;
- when the liquid helium is delivered to the utilization site in the form of pressurized containers, it is necessary to replace the containers all the more frequently when the amount of helium which they contain is small;
- when each production line is connected to its own helium reservoir, the complexity of the plant is increased considerably through an increase in the number of equipment items which therefore, here again, increases the overall cost of the subsequent fabrication process.

OBJECTS OF THE INVENTION

The object of the present invention is therefore to overcome the aforementioned drawbacks by providing a process and a plant for supplying helium which can be used directly on a production site comprising a plurality of fabrication lines or units, operating independently of one another.

Another object of the present invention is also to make it possible to feed helium gas to a plurality of production lines consuming amounts of helium gas which vary from one line to another, flexibly, that is to say as a function of the specific requirements of each of the lines and therefore independently of the variations in consumption of the lines, with respect to one another.

SUMMARY OF THE INVENTION

The present invention therefore relates to a plant for supplying helium to a plurality of production lines, comprising:

- a helium source having an internal volume of at least 7000 litres,
- a network of a plurality of secondary ducts, each feeding at least one production line using helium gas,
- a main duct for conveying helium, connected upstream to the helium source and downstream to the network of secondary ducts feeding the production lines, each production line being fed with helium output by the helium source having an internal volume, that is to say a capacity in excess of 7000 litres.

Preferably, the plant according to the invention comprises one or more of the following characteristics:

- the helium source has an internal volume of at least 8000 litres, preferably at least 15,000 litres, more preferably of at least 20,000 litres, more preferably at least 40,000 to 50,000 litres;
- the helium source is mobile, such as a road tanker or a railway tanker, or static, such as a storage vessel or a buffer tank;
- the main duct is furthermore connected to at least one device selected from the group formed by a heat exchanger, a buffer tank, helium purification means, and/or compression means;
- it furthermore has means for controlling the flow rate and/or the pressure of helium gas in the main duct and/or in each of the secondary ducts of the network;
- the production lines are selected from the group formed by:
  - filling lines for diving gas cylinders,
  - feedlines for gas pockets or gas bags present in a dirigible airship, the feedlines then being branches of the main gas duct running through the dirigible airship. In other words, the main duct and the feedlines are then directly arranged inside the dirigible airship,
  - filling lines for safety airbag inflation containers,
  - fabrication lines for electronic products comprising at least one cooling site for wafers or printed circuits, the cooling being carried out using helium gas,
  - fabrication lines for optical fibres, or
  - lines for helium-quenching metal articles;
- the production lines are connected, independently of one another, to the main duct by means of the network,
- the helium drawn from the helium source is in gas, liquid or supercritical form, preferably in liquid or supercritical form.

The invention also relates to a process for supplying helium to a plurality of production lines, in which:

- a main duct is fed with helium drawn from a helium source having an internal volume of at least 7000 litres, preferably of at least about 10,000 litres,
- the helium is conveyed in the main duct to a network of a plurality of secondary ducts, each feeding at least one production line using helium gas, each of the production lines is fed with helium in gas form originating from the helium source.

Preferably, the process of the invention comprises one or more of the following characteristics:

the helium is drawn from the helium source in liquid or supercritical form and, after being drawn off, is subjected to at least one vaporization step so as to obtain helium gas, the pressure and/or the flow rate of helium in the main duct is adjusted as a function of the sum of the pressures and/or of the flow rates of helium gas in each of the secondary ducts.

BRIEF DESCRIPTION OF THE DRAWINGS

The present invention will now be described in more detail with the aid of the appended figures which are given by way of illustration but without implying any limitation.

DETAILED DESCRIPTION OF THE INVENTION

Figure 1:
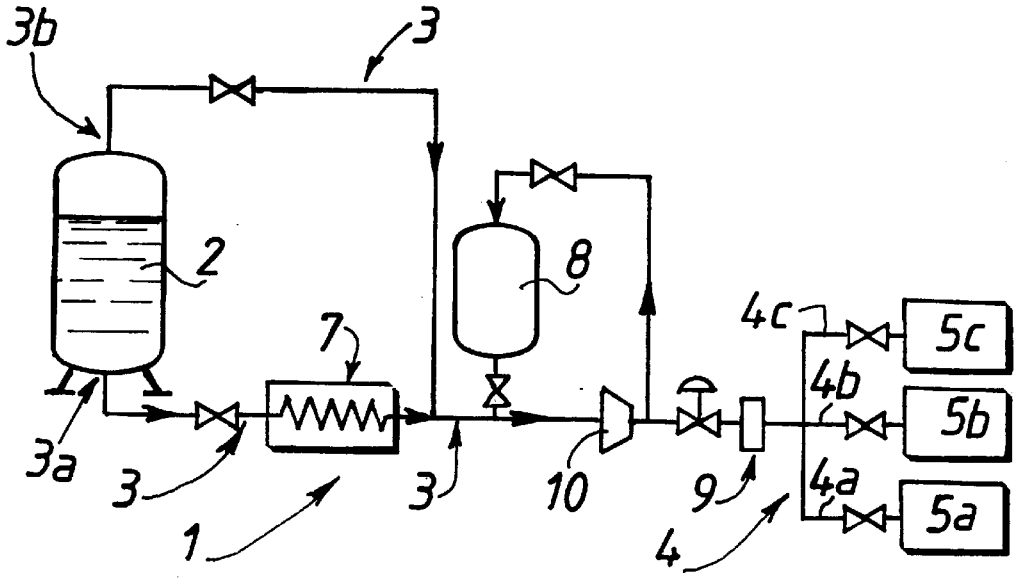
FIG. 1 represents an overall diagram of a plant 1 for supplying helium according to the present invention.

As represented in FIG. 1, the plant 1 for supplying helium comprises a helium source 2, for example a storage reservoir, having an internal volume of at least 7000 litres, for example about 10,000 litres, which helium source 2 is connected, via a main duct 3, 3*a*, 3*b* for conveying helium, to a network 4 of a plurality of secondary ducts 4*a*, 4*b*, 4*c*, each feeding one production line 5*a*, 5*b*, 5*c* with helium gas.

Depending on the particular case, the helium may be drawn from the storage reservoir 2 in liquid form, by virtue of the withdrawal means 3, then subsequently vaporized in the heat exchanger 7, or drawn directly in gas form via the withdrawal means 3*b*. Preferably, the helium is drawn in liquid or supercritical form.

In order to obtain a sufficient helium pressure in the duct 3, compression means 10 may be arranged along it, such as a piston or diaphragm compressor.

Furthermore, when the helium distributed to the various production lines 5*a* to 5*c* needs to have a level of impurities below a certain threshold, it is also possible to arrange helium purification means 9 along the duct 3, for example a filter or an adsorbent.

In addition, it is also possible to install a buffer tank 8 along the main duct 3.

Figure 2:
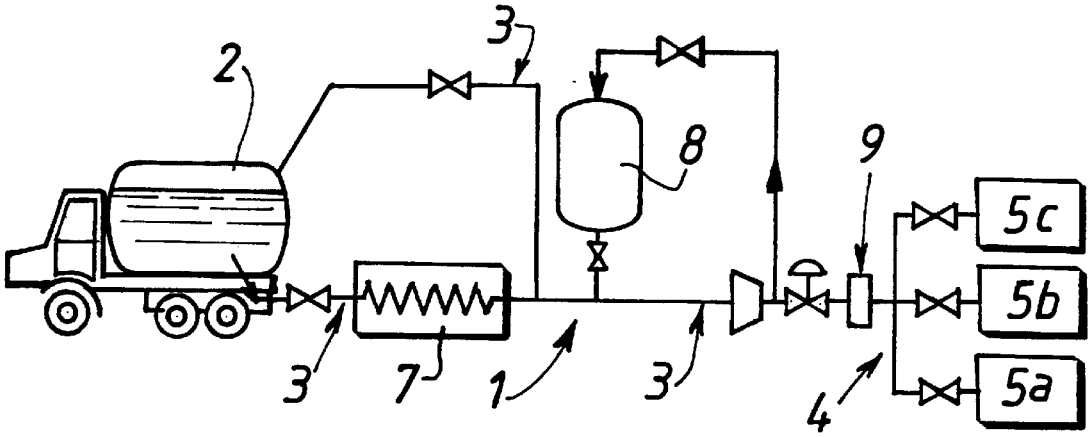
FIG. 2 represents a plant similar to that of FIG. 1 where the source of helium is a road tanker.

Depending on the particular case, the helium source 2 may be a fixed helium source, such as a storage reservoir as represented in FIG. 1, or a mobile source, for example a helium delivery lorry, as schematically represented in FIG. 2, which FIG. 2 is, moreover, substantially identical to FIG. 1.

For their part, FIGS. 3 to 6 represent several possible applications of the helium supply plant according to the present invention.

Figure 3:
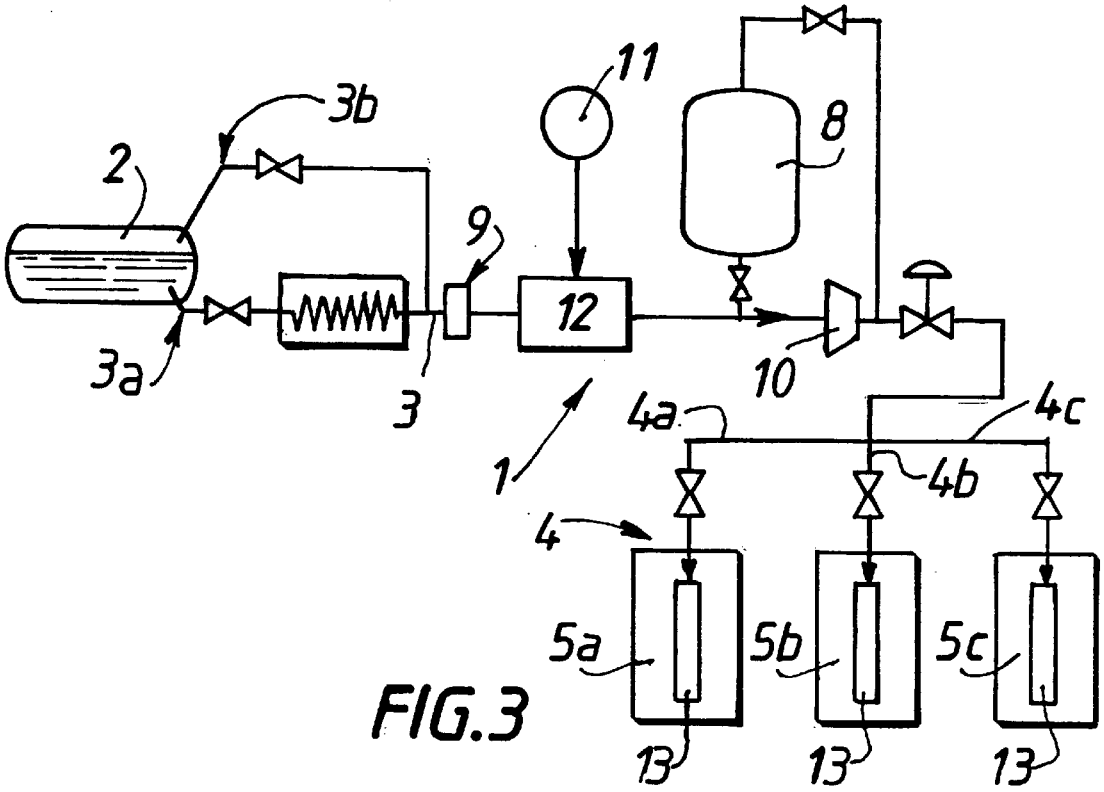
FIGS. 3 to 6 represent several possible applications of the helium supply plant according to the present invention.

More precisely, FIG. 3 schematically represents the application of the helium supply plant 1 described above to the filling of diving gas cylinders 13.

FIG. 3 thus repeats the same architecture as that in FIGS. 1 and 2, but also comprises a mixing and homogenizing device 12 which is arranged along the main duct 3 and is intended to obtain a uniform mixture of helium gas and one or more other gases output by a secondary gas source 11, in order to obtain a breathing gas mixture which can be used as breathing gas for a diving cylinder 13.

The diving gas mixture containing helium is then conveyed to a network 4 of a plurality of secondary ducts 4*a* to 4*c*, each feeding filling lines 5*a* to 5*c* for a diving gas cylinder 13.

Figure 4:
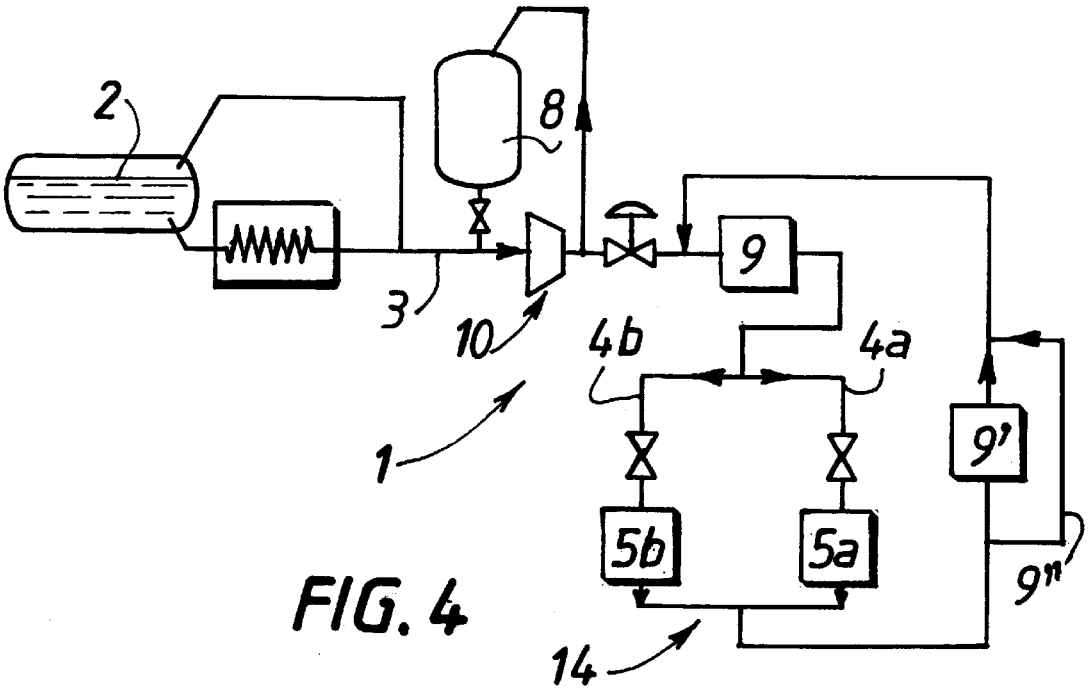

For its part, FIG. 4 schematically represents the use of a plant according to the invention on a fabrication site for electronic materials. As in the previous cases, the helium is conveyed by a duct 3 to a network 4 comprising a plurality of production lines 5*a* and 5*b*, such as cooling lines for wafers or printed circuits.

In this case, the device also comprises recovery and recycling means 14 for the used helium gas, which helium is recovered then, if appropriate, purified inside a recycled-gas prepurification unit 9' before being returned to the main duct 3, upstream of the purification means 9 where the prepurified helium thus recycled undergoes sufficient purification to allow it to be sent again to the production lines 5*a* and 5*b*.

However, when the used helium recovered by the recycling means 14 contains a level of impurities below a predetermined threshold, it is not absolutely necessary to make it undergo this prepurification, and it can then be returned to the line 3 by means of the bypass 9".

Figure 5:
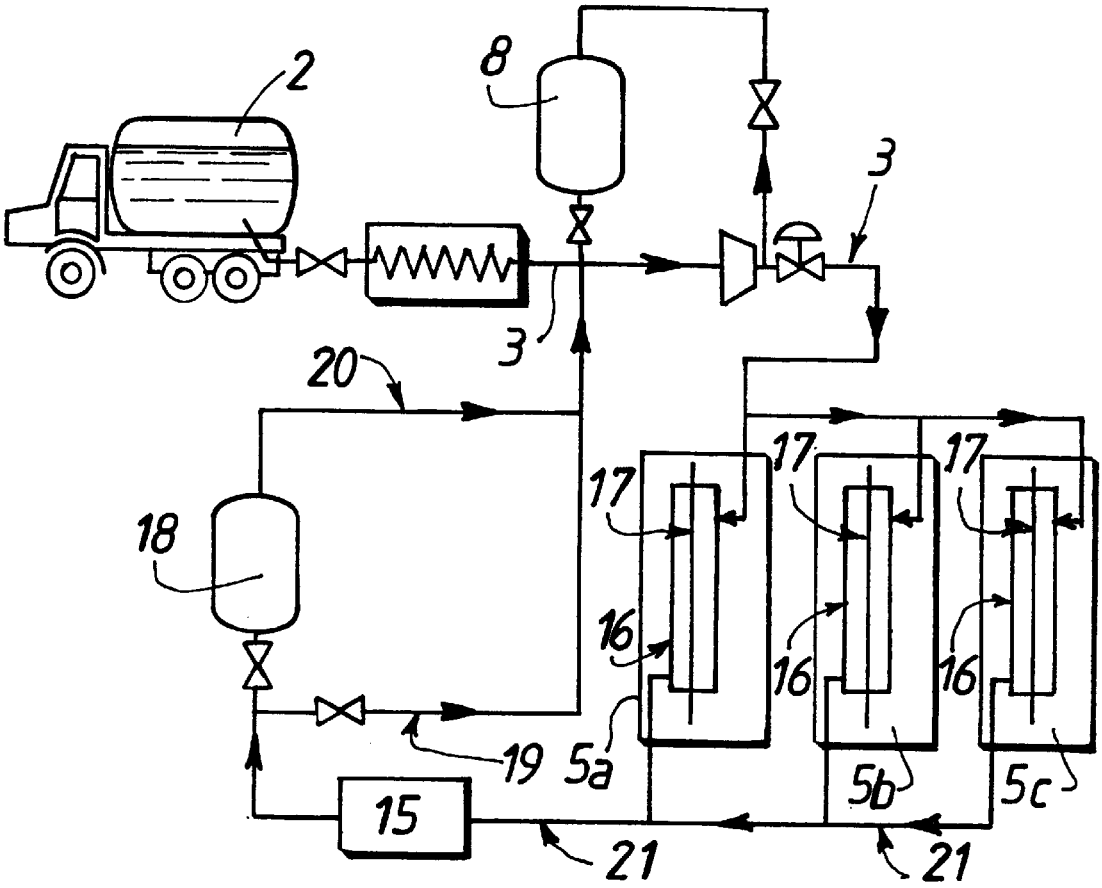

For its part, FIG. 5 represents a diagram of a plant according to the invention applied to the supplying of helium to fabrication lines 5*a* to 5*c*, for optical fibres 17, where the helium is used for cooling the fibres 17 when they pass through the cooling chambers 16.

The helium gas may, here again, be recovered at the outlet of the cooling chambers 16, discharged via ducts 21 to cooling means 15, then sent either directly to the main duct 3 by means of the bypass 19, or undergo prepurification inside the prepurification means 18 installed along the duct 20.

Figure 6:
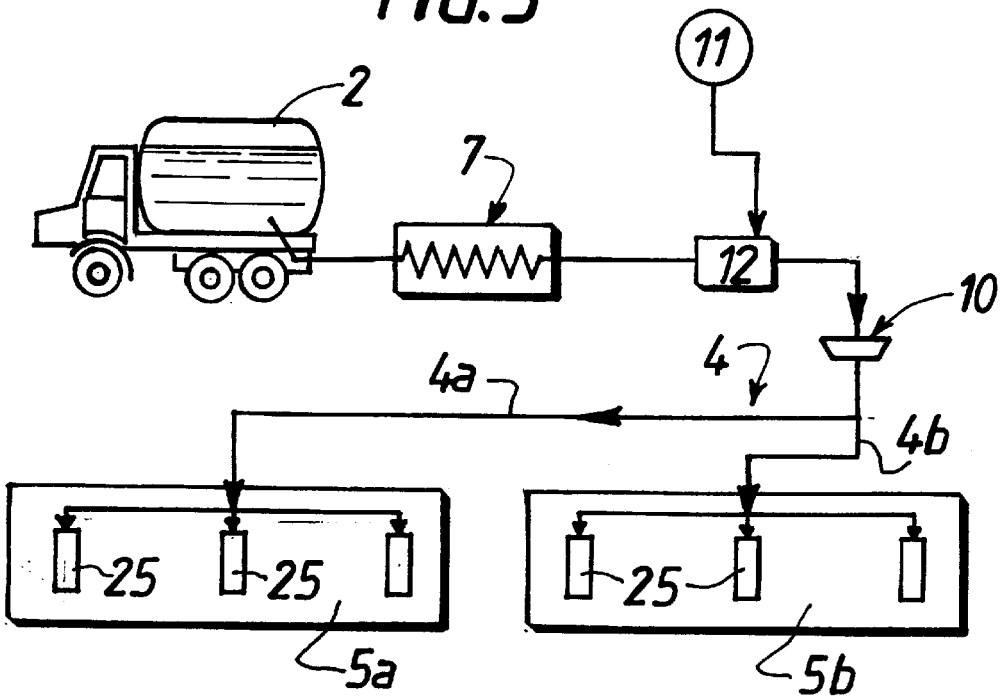

FIG. 6 represents the application of the plant for supplying helium of the invention to a fabrication unit for safety AIRBAGTM inflation containers 25.

In this case, a road tanker 2 with a capacity of at least 20,000 litres delivers liquid helium directly to the production site for the containers 25 for safety airbags. The helium drawn from the source 2 in liquid form is vaporized in the warmer 7, then undergoes, if necessary and optionally, dilution 12 with one or more other gases coming from a secondary gas source 11, then compression 10 before being sent to the network 4 of secondary ducts 4*a*, 4*b*, then being lastly introduced into the containers 25 for safety airbags.

The plant and the process according to the invention have several advantages, namely in particular that they make it possible to convey helium directly to the site where the helium is used, the helium being conveyed in liquid form in containers with very large dimensions, in general larger than 7000 litres, without necessarily having to undergo transfer, that is to say re-storage, between their sites of initial liquefaction or production and their utilization sites.

Furthermore, as can be seen in the preceding figures, the liquid helium can be vaporized to form helium gas directly on the utilization site, and the helium may then optionally undergo purification before being sent to the production lines where it will be used.

In general, a minimum flow rate of at least 2 $m^3/h$ and/or a pressure from $10^5$ Pa to $4\times10^7$ Pa should be complied with inside the main duct 3.

After use, the helium gas may optionally be recovered and recycled, possibly undergoing prepurification for its subsequent reuse.

Furthermore, each of the secondary lines 4*a* to 4*c* of the secondary duct network is connected only to a single helium source 2, while being independent of one another.

In other words, the process and the plant according to the present invention make it possible to obtain a very high degree of flexibility in the various production lines of the process using the helium, that is to say even though each line is fed by the same helium source 2, each of the production lines can at any time obtain the amount of helium gas needed for it to operate properly.

What is claimed is:

1. Plant for supplying helium to a plurality of production lines, comprising:

a helium source having an internal volume of at least 7000 liters and an outlet;

a network of a plurality of secondary ducts, each secondary duct structured and arranged to feed helium gas to at least one production line; and a main duct for conveying helium, said main duct being fluidly connected upstream to the outlet of the helium source and downstream to the network of secondary ducts feeding the production lines; each production line being structured and arranged to be fed with helium output by the helium source.

2. The plant according to claim 1, wherein the helium source has an internal volume of at least 8000 liters.

3. The plant according to claim 2, wherein the helium source has an internal volume of at least 20,000 liters.

4. The plant according to claim 3, wherein the helium source has an internal volume of at least 40,000 liters.

5. The plant according to claim 1, wherein the helium source is mobile.

6. The plant according to claim 1, wherein the helium source is fixed.

7. The plant according to claim 1, wherein the main duct is fluidly connected to a heat exchanger positioned upstream of the network and downstream of the outlet of the helium source.

8. The plant according to claim 7, wherein the main duct is fluidly connected to a buffer tank positioned upstream of the network.

9. The plant according to claim 8, wherein the main duct is fluidly connected to a compressor positioned downstream of the heat exchanger.

10. The plant according to claim 9, wherein the main duct is fluidly connected to a helium purification tank positioned upstream of the network.

11. The plant according to claim 1, further comprising means for controlling one of the flow rate and pressure of helium gas in the main duct.

12. The plant according to claim 1, further comprising means for controlling one of the flow rate and pressure of helium gas in each of the secondary ducts of the network.

13. The plant according to claim 1, wherein the production lines are selected from the group consisting of:

filling lines for diving gas cylinders, filling lines for safety airbag inflation containers, fabrication lines for electronic products comprising at least one cooling site for wafers or printed circuits, and fabrication lines for optical fibers.

14. The plant according to claim 1, wherein the production lines are connected, independently of one another, to the main duct by the network.

15. The plant according to claim 1, wherein helium drawn from the helium source is, at the outlet of the source, in liquid or supercritical form.

16. Process for supplying helium to a plurality of production lines, which comprises:

feeding a main duct with helium drawn from a helium source having a capacity in excess of 7000 liters;

conveying the helium in the main duct to a network of a plurality of secondary ducts, each secondary duct feeding at least one production line using helium gas; and feeding each of the separate production lines with helium in gas form originating from the helium source.

17. The process according to claim 16, wherein the helium drawn from the helium source is in liquid or supercritical form, and after being drawn off, is subjected to at least one vaporization step so as to obtain helium gas.

18. The process according to claim 16, further comprising adjusting the pressure of helium in the main duct as a function of the sum of the pressures of helium gas in each of the secondary ducts.

19. The process according to claim 16, further comprising adjusting the flow rate of helium in the main duct as a function of the sum of the flow rates of helium gas in each of the secondary ducts.

* * * * *